United States Patent [19]

Burgess

[11] 4,221,294

[45] Sep. 9, 1980

[54] IMPACT ABSORBING BOX

[75] Inventor: Norman E. A. Burgess, Westmount, Canada

[73] Assignee: Domtar Inc, Montreal, Canada

[21] Appl. No.: 40,654

[22] Filed: May 21, 1979

[51] Int. Cl.[3] ..... B65D 75/04; B65D 5/18; B65D 45/00; B65D 81/16

[52] U.S. Cl. ..... 206/521; 220/441; 229/33; 229/36

[58] Field of Search ..... 206/521, 523, 591, 392; 229/33, 36; 220/441

[56] References Cited

U.S. PATENT DOCUMENTS

| | | | |
|---|---|---|---|
| 2,732,995 | 1/1956 | Geisler et al. | 229/33 |
| 3,294,308 | 12/1966 | Tress et al. | 229/23 R |
| 3,826,420 | 7/1974 | Bamburg et al. | 229/33 |
| 4,067,442 | 1/1978 | Howe | 220/441 |

*Primary Examiner*—William T. Dixson, Jr.
*Attorney, Agent, or Firm*—C. A. Rowley

[57] ABSTRACT

An impact absorbing carton is formed with a bottom wall that is formed from the single rectangular bottom panel that is weakened and a rim is provided between the weakened area and the edges of the panel preferably with fold lines extending substantially diagonally between each of the corners of the bottom panel across the rim to the adjacent edges of the weakened area so that if the box is dropped the bottom of the panel will give and absorb the impact.

5 Claims, 6 Drawing Figures

IMPACT ABSORBING BOX

FIELD OF THE INVENTION

Present invention relates to an impact resistant box, more specifically the present invention relates to a corrugated container having an impact absorbing bottom.

DESCRIPTION OF THE PRIOR ART

Reinforced box structure for nails or the like, heavy products are generally formed by providing a plurality of piles of the box forming material laminated to form a relatively ridged structure that will withstand the shock etc., to which such boxes are subjected when they are dropped or otherwise mishandled without significant distortion. Obviously such extra material increases significantly the cost of these boxes.

It is the object of the present invention to provide an impact resistant box capable, when loaded, to withstand an impact by distorting thereby to absorb the impact without rupturing of the box.

SUMMARY OF THE INVENTION

Broadly, the present invention comprises a box structure having a bottom wall formed by a rectangular bottom panel, a weakened area in said panel, a rim between the weakened area and the edges of the bottom panel the width of said rim and the area of said weakened area buckling when subjected to impact loading whereby said box when full may be dropped and will better absorb the impact on contact by distortion of the box without splitting open. Preferably fold lines will extend substantially diagonally from each corner of the bottom panel across the rim to the adjacent edges of said weakened area.

BRIEF DESCRIPTION OF THE DRAWINGS

Further features, objects and advantages will be evident from the following detailed description of the preferred embodiments of the present invention taken in conjunction with the accompanying drawings in which.

Figure 1:
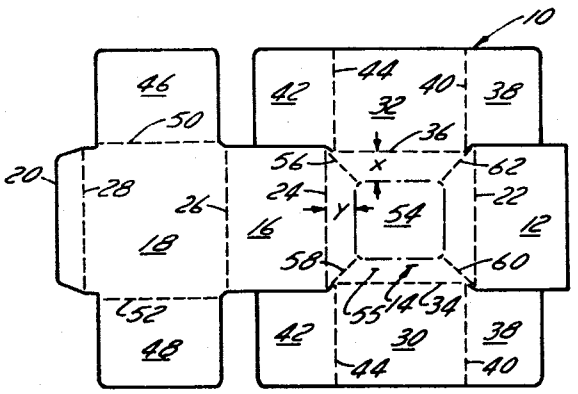
FIG. 1 is a plan view of a box structure incorporating the present invention.

The blank 10 of FIG. 1 is formed of corrugated box board and comprises a front panel 12, a bottom panel 14, a rear panel 16, top panel 18, and a top closure flap 20 foldably interconnected by a set of parallel fold lines 22, 24, 26 and 28. A pair of side walls 30 and 32 are connected to opposite sides of the bottom panel 14 by fold lines 34 and 36 respectively which are substantially perpendicular to the fold lines 22, 24, 26 and 28. Each of these side walls 30 and 32 is provided with front wall reinforcing flap 38 connected thereto by fold lines 40 and with rear wall reinforcing flaps 42 connected thereto by fold lines 44. The fold lines 40 and 44 are substantially parallel to the fold lines 22, 24, 26 and 28.

The top panel 18 is provided with a pair of side reinforcing flaps 46 and 48 connected to opposite sides of the panel 18 by fold lines 50 and 52.

The bottom panel 14 is provided with a weakened area 54 formed by crushing that covers a significant portion of the bottom panel 14 and is surrounded by a rim 55 that extends substantially to the edges of the bottom panel 14. Preferably substantially diagonal fold lines 56, 58, 60 and 62 extend across the rim 55 and connect the corners of the bottom panel 14 with the crushed area 54 to facilitate buckling or distortion of the bottom panel on impact.

As indicated the crushed area 54 is centred in the panel 14 and is spaced from the fold lines 34 and 36 by substantially the same distance X and from the fold lines 22 and 24 by substantially the same distance Y. Distances X and Y define the width of the rim 55 and may be slightly different but in any event will be designed in accordance with the size of the box and the desired impact resistance i.e. degree of resistance to buckle. Generally the distance X will not be less than ½" to provide a reasonable width rim 55 around the bottom of the box to retain the normal shape of the box, however, it also should not exceed about 3". Generally the crushed area 54 of the bottom panel 14 will constitute at least half the area of the bottom panel. The width of the rim 55 determines the resistance to buckling or distortion and thus the forces necessary to distort the box (which must be less than those required to burst the box open on impact). The strength of the rim is determined in part by lines 56, 58, 60 and 62 which preferably are used to control the strength of rim 55 and better insure the location where the box buckles to absorb the impact. The rim thus strengthens the box to insure it retains the shape under normal handling while permitting distortion to absorb impact without bursting of the box when the box is dropped.

The blank of FIG. 1 is formed into a carton by folding the side panels 30 and 32 into a position perpendicular to the bottom panel along fold lines 34 and 36 and then folding the flaps 38 and 42 along fold lines 40 and 44 into a position substantially perpendicular to the side walls 30 and 32. Front wall 12 and rear wall 16 are then folded into face-to-face relationship with the flaps 38 and 42 respectively and secured in this position. The flaps 20, 46 and 48 may be folded into position substantially perpendicular to the top panel 18 along fold lines 28, 50 and 52 respectively so that the top panel 18 may be used to close the container with the flaps 20, 46, 48 being in face-to-face relationship with the inside of flaps 38 and walls 32 and 30 respectively.

Figure 4:
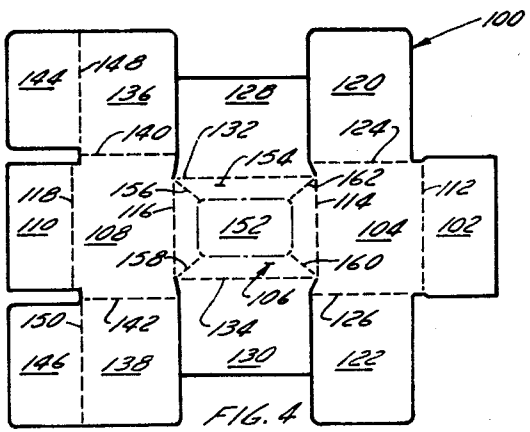
FIG. 4 is a plan view of another carton blank incorporating the present invention.
Figure 2:
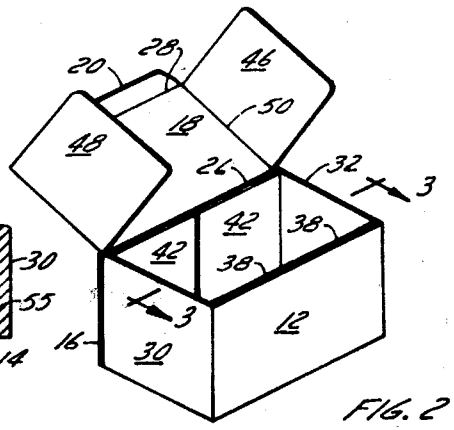
FIG. 2 is an isometric view of the blank of FIG. 1 erected but with the top open.
Figure 5:
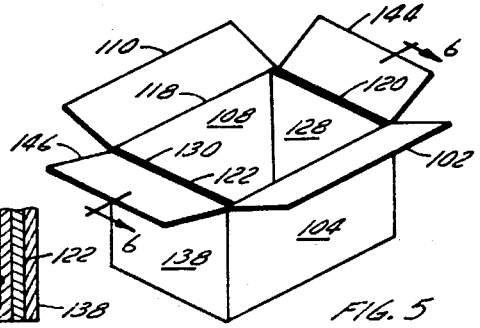
FIG. 5 is an isometric view of a box formed from the carton blank of FIG. 4.
Figure 3:
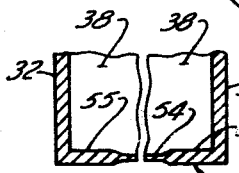
FIG. 3 is a partial section along the lines 3—3 of FIG. 2.
Figure 6:
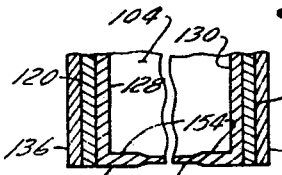
FIG. 6 is a partial section along the lines 6—6 of FIG. 5.

FIGS. 4 and 6 inclusive illustrate another box blank and box formed therefrom and incorporating the present invention. It will be seen that the blank 100 is formed by a top flap 102, a front wall 104, a bottom wall 106, a rear wall 108 and a second top flap 110, foldably interconnected by a set of substantially parallel fold lines 112, 114, 116 and 118. The front wall 104 has a pair of side reinforcing flaps 120 and 122 connected thereto by a pair of fold lines 124 and 126. The bottom wall 106 has a pair of side walls 128 and 130 connected thereto by a pair of substantially parallel fold lines 132 and 134 respectively and the rear wall 108 has a pair of side reinforcing flaps 136 and 138 secured thereto by a pair substantially parallel fold lines 140 and 148. Fold lines 124, 126, 132, 134, 140, 148 are substantially parallel with each of the pairs being spaced apart by slightly different distances corresponding substantially to the thickness of the corrugated box board being used so that when the carton is erected the panels and the flaps may be folded into overlaying relationship.

A pair of top closure flaps 144 and 146 are connected to the side reinforcing flaps 136, 138 by fold lines 148 and 150 respectively, the latter fold line being substantially parallel to the fold lines 112, 114 and 116 and 118.

As with the previous embodiment, the bottom panel 106 is provided with a centre crushed area 152 equivalent to the area 54 of the above described embodiment surrounded by retaining rim 154. The rim 154 extends between the crushed area 152 and the various fold lines 114, 132, 116 and 134 defining the edges of the bottom panel 106 and is preferably weakened by four substantially diagonal fold lines 156, 158, 160 and 162 extending between the corners of the bottom panel 106 and the adjacent edges of the crushed area 152.

The size of the rim 154 and of the crushed area 152 is substantially equivalent to the size of the rim 55 and the crushed area 54 in the previous embodiment correlated in the same manner with the size of the carton being manufactured. The carton of FIG. 4 is set up by folding the side walls 128 and 130 perpendicular to the bottom wall 106 along fold lines 132 and 134. Next, front wall 104 is folded along fold line 114 into a position perpendicular to the bottom wall 106 and the side reinforcing flaps 120 and 122 are folded along the fold lines 124 and 126 in face-to-face relationship walls 128 and 130 respectively. Followed by folding of the rear wall 108 along fold line 116 to a position perpendicular to the bottom wall 106 and folding rear side reinforcing flaps 136, 138 along fold lines 140 and 148 in face-to-face relationship with the flaps 120 and 122 respectively and the carton is secured together in this condition. To close the top of the carton, the flaps 144, 146 are folded in along fold lines 148 and 150 and the flaps 102 and 110 are folded along the fold lines 112 and 118 respectively in overlying relationship with the flaps 144 and 146.

Both of the above described cartons incorporate the impact resistance structure of the present invention which is formed by crushing a significant portion of the bottom forming panel to provide a rim weakened by diagonal fold lines extending across rim and joining the crushed area with the corners of the bottom panel.

In operation, the box is filled with say nails or the like material and is closed, should it be dropped the bottom deflects along one more of the diagonal fold lines, the length of which, of course, is determined by the width of the rim. This distortion permits the box itself to distort and thereby absorb the impact. It has been found that dropping a box of nails 5 to 9 inches high and $9\frac{1}{2}\times9\frac{1}{2}$ square containing 50 lbs of nails 2 to 3 feet repeatedly withstood the impact. The box could be dropped with nails 3″ about three times and with shorter nails considerable more times without rupture, whereas, a similar box not having the bottom panel of the present invention could not survive a single drop.

Modifications may be made without departing from the spirit of the invention as defined in the appended claims.

I claim:

1. An impact absorbing box structure formed of corrugated boxboard comprising, a bottom wall formed by a substantially rectangular bottom panel, a weakened area formed in said panel by crushed corrugations in said corrugated board substantially throughout said weakened area, a rim separating said weakened area and the edges of said bottom panel, fold lines extending substantially diagonally from each corner of said panel across said rim to adjacent edges of said weakened area, said rim being of substantially uniform width of between $\frac{1}{2}$ and 3″, said fold lines, said width and the amount of said weakened area cooperating to hold said box in shape under normal conditions, yet sufficiently weakening said bottom panel to facilitate buckling thereof and permitting said box to distort when subject to significant impact thereby to absorb said impact without bursting of said box.

2. A box as defined in claim 1 further comprising, a front wall and back wall foldably connected to opposite end edges of said bottom panel and a pair of side walls foldably connected to opposite sides of said bottom panel.

3. A box as defined in claim 2 further comprising, side reinforcing flaps foldably connected to the side edges of each of said front and rear panel, said side reinforcing flaps on each side of said carton being adapted to be folded into face-to-face relationship with each other and with an adjacent of said side walls.

4. A box as defined in claim 3 further comprising, front and rear reinforcing flaps foldably connected to each of said side walls and adapted to be folded into face-to-face relationship with said front and rear walls respectively.

5. A box as defined in claim 1, 2, 3 or 4 wherein the amount of said weakened area is at least 50% of the area on said bottom panel.

* * * * *